United States Patent [19]

Nayler et al.

[11] 4,154,358

[45] May 15, 1979

[54] LIQUID STORAGE TANK WITH SLIDING ROOF SEAL

[75] Inventors: Irenie M. Nayler, Dudley; Gerald H. Gostick, Walley Bridge, both of England

[73] Assignees: Greengate Industrial Polymers Limited, Salford; Nayler (Petro-Seals) Limited, Dudley, both of England

[21] Appl. No.: 814,871

[22] Filed: Jul. 12, 1977

Related U.S. Application Data

[63] Continuation-in-part of Ser. No. 641,505, Dec. 17, 1975, abandoned.

[51] Int. Cl.[2] ..... B65D 87/20; B65D 87/207

[52] U.S. Cl. ..... 220/222; 220/224

[58] Field of Search ..... 220/222, 224, 226, 225

[56] References Cited

U.S. PATENT DOCUMENTS

| | | | |
|---|---|---|---|
| 2,651,433 | 9/1953 | Mjellem | 220/222 |
| 2,914,212 | 11/1959 | Fino | 220/222 |
| 2,919,047 | 12/1959 | Fino | 220/222 |
| 3,261,496 | 7/1966 | Joor | 220/225 |
| 3,565,279 | 2/1971 | Joor | 220/224 |

FOREIGN PATENT DOCUMENTS

| | | | |
|---|---|---|---|
| 41994 | 12/1971 | Japan | 220/226 |
| 929723 | 6/1963 | United Kingdom | 220/226 |

*Primary Examiner*—William Price
*Assistant Examiner*—Steven M. Pollard
*Attorney, Agent, or Firm*—Norris & Bateman

[57] ABSTRACT

An annulus of individual seal sections mounted in sealed end to end abutment is disposed between coextensive side wall portions of a liquid storage tank and a floating roof, the seal sections being individually removably mounted on the roof side wall.

4 Claims, 4 Drawing Figures

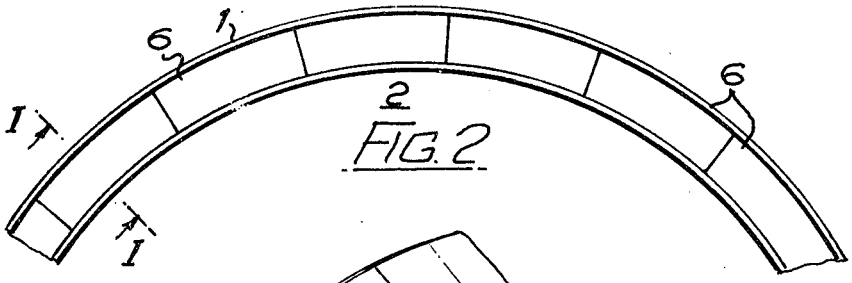
FIG. 2
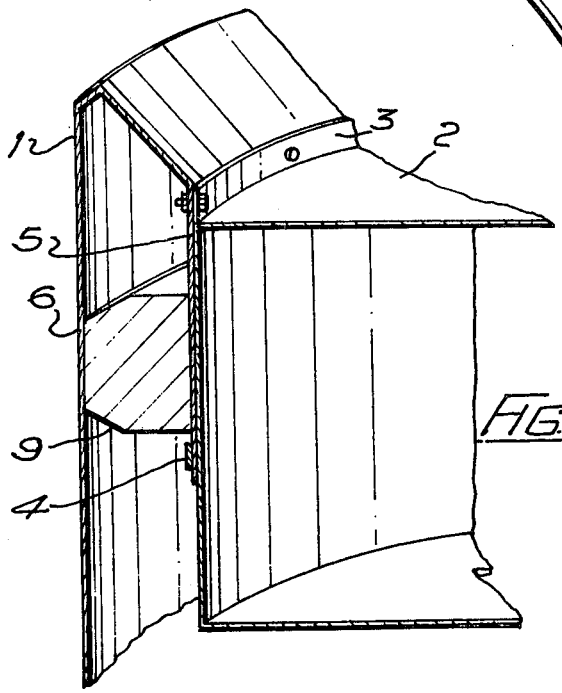
FIG. 1
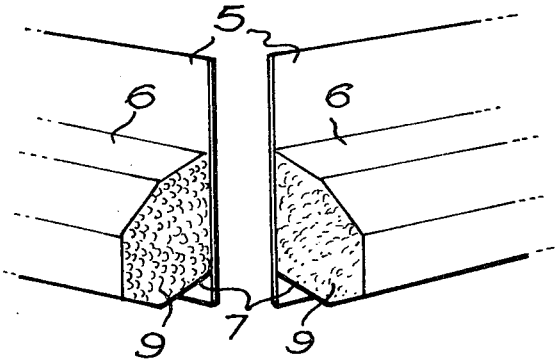
FIG. 3
FIG. 4
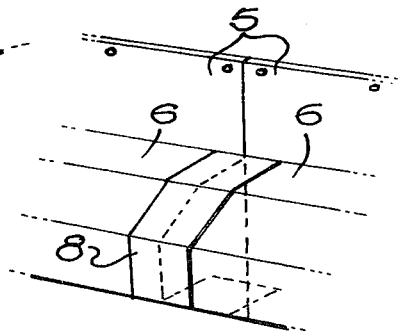

LIQUID STORAGE TANK WITH SLIDING ROOF SEAL

This is a continuation-in-part of Ser. No. 641,505 filed Dec. 17, 1975, now abandoned.

This invention relates to improvements in a floating roof for a liquid storage tank, the roof being of the type which moves vertically as the liquid level rises and falls in the tank and which is fitted with a seal in the space between the roof and tank wall to prevent evaporation of the stored liquid and ingress of foreign substances.

Some known seals of the above type incorporate a bag of for example coated textile fabric filled with synthetic foam material or a suitable liquid. However, these seals are generally in the form of a continuous tube inserted between the roof and the tank wall and their installation and repair when damaged requires a team of workers because the whole of the tube, which of necessity fits tightly between the roof and the tank wall, has to be man-handled during the installation and repair operations.

According to the invention a floating roof for a liquid storage tank has a seal adapted to be supported between a side wall of the roof and the tank wall in the form of a plurality of individual sealing sectional elements of preferably polygonal cross section, each section consisting of a block of synthetic foam material enclosed in an abrasion and liquid resistant rubber coated fabric cover or plastics material coated fabric cover supported by a separate plate separately bolted to the rim of the floating roof and slidably inserted and supported at the lower edge in a channel or the like formed on the side wall of the roof.

The invention will be described with reference to the accompanying drawings;

FIG. 1 is a section of part of a liquid storage tank and floating roof showing the seal in position on line 1—1 of FIG. 2;

FIG. 2 is a plan view showing a segment of the sectional annular seal assembly;

FIG. 3 is a perspective view of the adjacent ends of two sections showing one means of sealing the ends; and FIG. 4 is a perspective view of a further means of sealing the ends of two adjacent sections.

A liquid storage tank 1 is provided with a floating roof 2 having an upper peripheral rim 3 and with a channel or socket defining member 4 secured on the side wall of the roof to removably receive the lower edge of a plate 5 supporting a seal section 6, the upper edge of the plate 5 being bolted to the rim 3.

The seal assembly comprises a plurality of segmental sections 6 mounted in end to end abutment to form an annular seal assembly, each section 6 preferably of foamed rubber or foamed plastics material enclosed in an abrasion and oil resistant rubber or synthetic plastics coated fabric cover and being of polygonal shape in cross section. Each section is affixed to a separate plate 5 and thus can be removed and replaced from the top of the roof independently of other plates 5. When each plate 5 is mounted on the roof its lower end moves slidably into channel 4 until the upper end can be bolted to rim 3. Thus it is possible for one man to assemble the unit plate by plate all around the tank, and to remove and repair or replace any one defective section 6. The fabric cover 9 for each section is made from an abrasion and oil resistant rubber or plastic material coated fabric.

In the assembly shown in FIG. 1 the outer peripheral surface of each section 6 slidably sealably engages the inner wall surface of tank 1.

Plate 5 is of stiff material, preferably metal, and shaped to the contour of the roof side wall. The sections 6 are sufficiently resilient radially for good sealing. It will be noted that each body 6 is circumferentially coextensive with the arcuate plate on which it is mounted.

The ends of the adjacent sections 6 in assembly abut in compression and may be removably secured together to seal adjacent sections by Velcro (Trademark) hook and loop members 7 as shown in FIG. 3 or by molded end caps or adhesive or like tape 8 (FIG. 4) to engage over the ends of adjacent sections.

The fabric cover 9 of the sections may be provided with vent holes to allow for the escape of air when the seal is compressed between the tank wall and the wall of the roof.

It will be appreciated that a seal comprising individual sections as described above is much more easily installed in the space between the roof and wall of a liquid storage tank because the sealing sections can be placed in position one at a time and their size may be regulated during manufacture so that each section is easily handled by one man.

Similarly, if damage occurs to any sealing section during service it can be easily and conveniently removed and replaced without the necessity for removal of the whole seal assembly.

The sections may be fabricated in standard lengths and stocked for use.

We claim:

1. In a liquid storage tank assembly, a liquid containing tank having a side wall, a roof adapted for floating on liquid in said tank and having a side wall radially spaced inwardly from and longitudinally coextensive with a portion of the tank side wall, and an annular seal assembly mounted in the space between said side walls, said seal assembly comprising a multiplicity of segmental sections individually removably mounted upon said roof side wall with their adjacent ends abutting, each said section comprising and individual plate separately removably fastened to the roof at its upper end and freely removably received at its lower end in means on the roof side wall and a body of resilient oil resistant material mounted on each plate with its outer periphery in sealing engagement with said tank side wall, whereby any one of said sections may be installed or removed from the top of the roof outside the tank as a unit independently of the other sections, thus rendering it unnecessary for installation and/or maintenance personnel to enter the tank under the floating roof, and means providing a releasable liquid tight bond and seal between the abutting ends of adjacent sections in the assembly.

2. In the liquid storage tank assembly defined in claim 1, each said plate being secured by removable fastening means to a peripheral rim upstanding around the upper part of said roof, and having its lower end slidably received in a channel or socket on the roof side wall.

3. In the liquid storage tank assembly defined in claim 1, said seal sections being polygonal in cross section.

4. In the liquid storage tank assembly defined in claim 1, each plate being of stiff material shaped to the contour of the roof side wall, each resilient body being substantially circumferentially coextensive with the plate it is mounted upon, and adjacent plates and resilient bodies being in end abutment in substantially the same radial planes.

* * * * *